US005819137A

United States Patent [19]

Hoffman et al.

[11] Patent Number: 5,819,137

[45] Date of Patent: Oct. 6, 1998

[54] INTEGRATED ENVIRONMENTAL MANAGEMENT FOR REPRODUCTION APPARATUS

[75] Inventors: Gary P. Hoffman, Middlesex; John F. Quester, Hilton; Clifton T. Hartford, Caledonia; David R. Heberle, Webster; Kurt E. Jones, Rochester; David E. Hockey, Brockport; Philip A. Stern, Spenceport, all of N.Y.

[73] Assignee: Eastman Kodak Company, Rochester, N.Y.

[21] Appl. No.: 885,309

[22] Filed: Jun. 30, 1997

[51] Int. Cl.[6] ..... G03G 21/00

[52] U.S. Cl. ..... 399/93; 399/92; 399/100

[58] Field of Search ..... 399/91, 92, 93, 399/94, 97, 98, 100, 343; 181/224; 15/300.1, 319, 326, 339; 310/314, 334; 55/342, 350, 385.2, 385.4, 413

[56] References Cited

U.S. PATENT DOCUMENTS

| | | | |
|---|---|---|---|
| 5,073,796 | 12/1991 | Suzuki et al. | 399/93 |
| 5,128,110 | 7/1992 | Soga et al. | 399/93 X |
| 5,189,473 | 2/1993 | Negoro et al. | 399/93 |
| 5,243,386 | 9/1993 | Araki et al. | 399/93 |
| 5,307,132 | 4/1994 | Tsuchiya | 399/92 X |
| 5,479,242 | 12/1995 | Sato et al. | 399/92 |
| 5,689,766 | 11/1997 | Hollar et al. | 399/92 |
| 5,696,361 | 12/1997 | Chen | 181/224 |

*Primary Examiner*—Arthur T. Grimley
*Assistant Examiner*—Sophia S. Chen
*Attorney, Agent, or Firm*—Lawrence P. Kessler

[57] ABSTRACT

An integrated environmental management system for reproduction apparatus including a reprographic marking engine for reproducing information supplied thereto and accessories for facilitating the handling of reproduction output from the marking engine. The integrated environmental management system includes a housing associated with the reprographic marking engine. The housing defines a chamber having, in communication, a rear wall substantially parallel to the rear of the reprographic marking engine, first and second side walls, and top and bottom walls. An inlet plenum in the housing chamber communicates, for example, with an opening in the first side wall of the housing. The inlet plenum includes an inlet filter for preventing contaminants in ambient air from entering the inlet plenum, a first inlet duct directed into the general interior of the reprographic marking engine, and a plurality of inlet ducts directed respectively to specific systems within the reprographic marking engine. An exhaust plenum in the housing chamber communicates, for example, with an opening in the second side wall of the housing. The exhaust plenum includes a first exhaust duct directed from the general interior of the reprographic marking engine, a plurality of exhaust ducts directed respectively from specific systems within the reprographic marking engine, and a filter for preventing contaminants carried by air flow from within the reprographic marking engine from exiting through the exhaust plenum. At least one fan is provided for moving air from the inlet plenum through the reprographic marking engine and through the exhaust plenum. The fan has a control for regulating the speed thereof to maintain a desired air flow for a given power output of the reprographic marking engine.

19 Claims, 6 Drawing Sheets

INTEGRATED ENVIRONMENTAL MANAGEMENT FOR REPRODUCTION APPARATUS

BACKGROUND OF THE INVENTION

The present invention relates in general to internal and external environment of reproduction apparatus, and more particularly to an integrated environmental management system for reproduction apparatus.

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

Reproduction apparatus, of the above described type, and their environment have a significant interrelation. Such apparatus generate appreciable heat, noise, and ozone. It is necessary to control the heat and ozone within the reproduction apparatus to ensure that the apparatus operates at maximum efficiency. Excess heat or ozone can markedly degrade the desired output of the reproduction apparatus. Likewise, it is necessary to control the heat, noise and ozone in the ambient environment surrounding the reproduction apparatus to assure user safety. It has been the general practice to evaluate the overall heat, noise, and ozone produced by the reproduction apparatus, specifically with respect to each of the individual component factors. Then that component is addressed to maximize the desired control of such component. However, it is clear that the various individual environmental component factors are interrelated, and independent control of one component factor may have a negative impact on control of another component factor. As an illustrative example, a plan for reducing heat generated within the reproduction apparatus may require the addition of cooling devices such as fans. However, such cooling devices may, in turn, generate elevated noise levels. Conversely, adding insulation to reduce sound produced by the reproduction apparatus, may cause the internal temperature generated within the reproduction apparatus to rise to levels which have a significant negative impact on apparatus operation.

SUMMARY OF THE INVENTION

In view of the foregoing discussion, this invention is directed to an integrated environmental management system which will take into effect heat, noise, and ozone generation within the reproduction apparatus, and provide the most satisfactory environment both within the reproduction apparatus and in the surrounding areas. The integrated environmental management system includes a housing associated with the reprographic marking engine. The housing defines a chamber having, in communication, a rear wall substantially parallel to the rear of the reprographic marking engine, first and second side walls, and top and bottom walls. An inlet plenum in the housing chamber communicates, for example, with an opening in the first side wall of the housing. The inlet plenum includes an inlet filter for preventing contaminants in ambient air from entering the inlet plenum, a first inlet duct directed into the general interior of the reprographic marking engine, and a plurality of inlet ducts directed respectively to specific systems within the reprographic marking engine. An exhaust plenum in the housing chamber communicates, for example, with an opening in the second side wall of the housing. The exhaust plenum includes a first exhaust duct directed from the general interior of the reprographic marking engine, a plurality of exhaust ducts directed respectively from specific systems within the reprographic marking engine, and a filter for preventing contaminants carried by air flow from within the reprographic marking engine from exiting through the exhaust plenum. At least one fan is provided for moving air from the inlet plenum through the reprographic marking engine and through the exhaust plenum. The fan has a control for regulating the speed thereof to maintain a desired air flow for a given power output of the reprographic marking engine.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
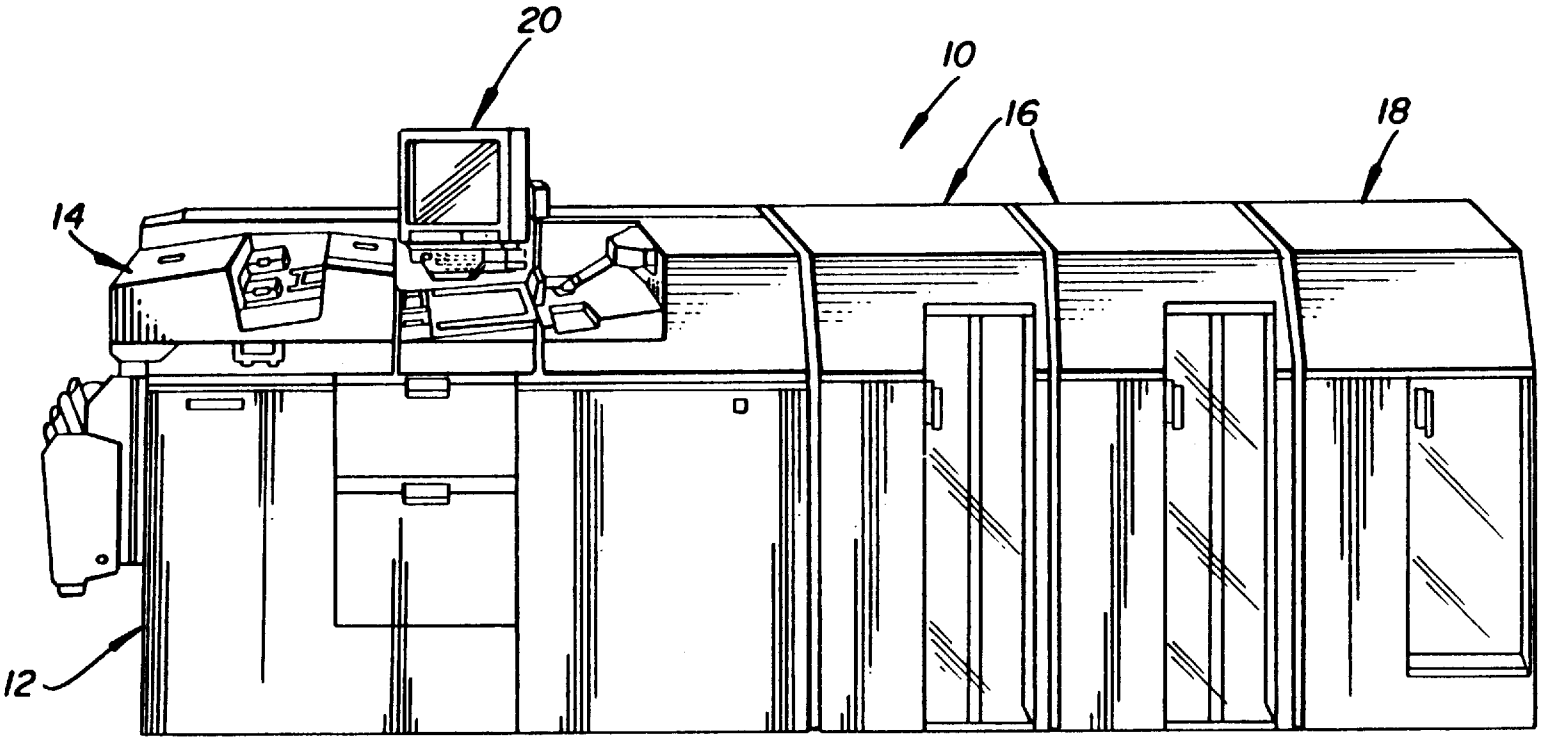
FIG. 1 is a front elevational view, in perspective, of an exemplary reproduction apparatus adapted to include the integrated environmental management system according to this invention.
Figure 2:
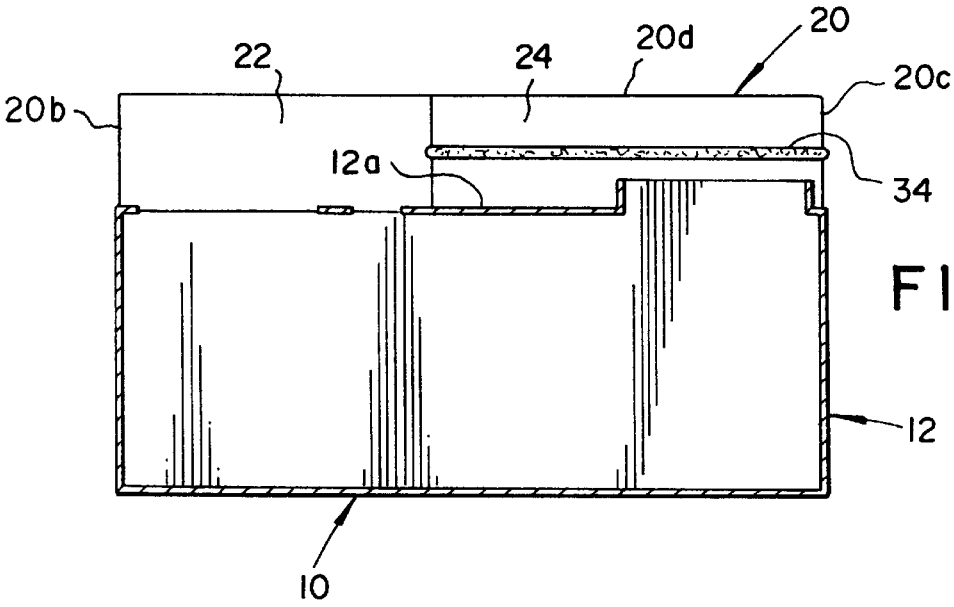
FIG. 2 is a top plan view of the reproduction apparatus of FIG. 1, partially in cross-section, and with portions removed to particularly show the integrated environmental management system according to this invention.
Figure 3:
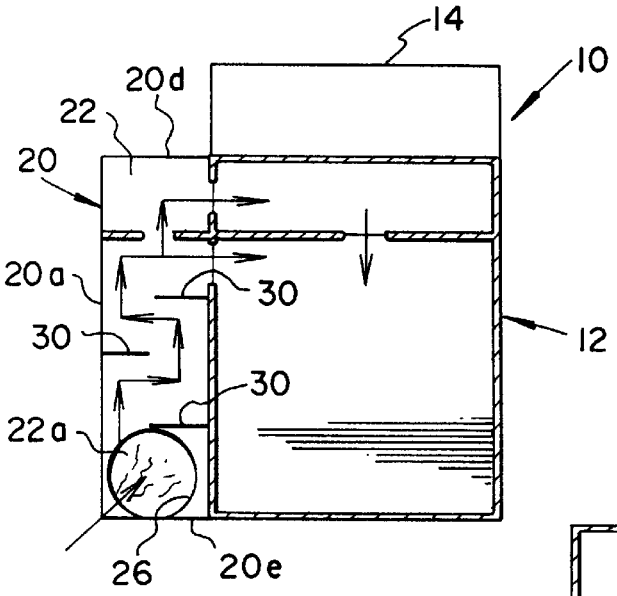
FIG. 3 is a left hand side elevational view of the reproduction apparatus of FIG. 1, partially in cross-section, and with portions removed to particularly show the integrated environmental management system.
Figure 4:
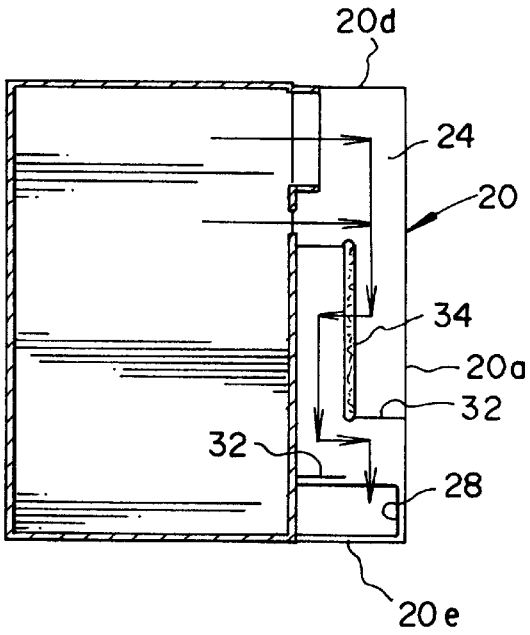
FIG. 4 is a right hand side elevational view of the reproduction apparatus of FIG. 1, partially in cross-section, and with portions removed to particularly show the integrated environmental management system.

Referring now to the accompanying drawings, an exemplary reproduction apparatus, designated generally by the numeral 10, is shown in FIG. 1.

The reproduction apparatus 10 includes a reprographic marking engine 12 for reproducing information supplied thereto, such as by an original document sheet feeder 14, and a variety of accessories for facilitating the handling of reproduction output from the marking engine. In the apparatus 10 shown here, the accessories include a plurality of sorter towers 16, and a stacker/stapler 18. Of course, other accessories, such as binders or folders, are suitable for use with this invention. The sorter towers, and stacker/stapler are of any particular construction well known in the art of reproduction apparatus.

The reprographic marking engine 12 of the depicted reproduction apparatus 10 is, for example, an electrographic copier or printer, or a combination of the two. Generally speaking, a copier reproduces information from original documents by optical exposure of such documents, while a printer reproduces information from electronic signals representative of such information. Of course, other arrangements for reproduction apparatus, utilizing a different type of reprographic marking engine, or a different number or arrangement of accessories, are suitable for use with this invention.

As noted above, electrographic reproduction apparatus and the environment for such apparatus are significantly interrelated. Heat, noise, and ozone produced by operation of the reproduction apparatus must be optimally accounted for and controlled to assure that the reproduction apparatus functions at peak efficiency without adversely effecting the surrounding environment and subjecting users to various associated health risks. Therefore, this invention provides an environmental management strategy which integrates control of those component factors (i.e., heat, airflow, noise, and ozone) having an impact on both the interior and exterior environment of the reproduction apparatus. As such, the deleterious impact on the surrounding environment for the reproduction apparatus will be minimized, and the operating environment within the reproduction apparatus will be enhanced. The integrated environmental management strategy, according to this invention, will provide sufficient forced air cooling to match power consumption of the reproduction apparatus, capture substantially all acoustic energy within the reproduction apparatus and dissipate it there through the process of absorption, provide cooling air inlet and exhaust passages which do not compromise the acoustic performance of the reproduction apparatus, and use a catalytic ozone reduction filter in a common air exhaust passage. All of the above is accomplished without increasing the total space required for the reproduction apparatus (that is, the foot print of the apparatus at the user cite), while accommodating for any additional environmental impact resulting from optional accessories added to the reproduction apparatus.

As shown in FIGS. 2–6, the reproduction apparatus 10 has an integrated environmental management system according to this invention associated therewith. Specifically with regard to the environmental management system, the reprographic marking engine 12 of the apparatus 10 has a plenum housing 20 in juxtaposition with substantially the full width and height of the reprographic marking engine and affixed to the rear wall 12*a* thereof. The housing 20 has a rear wall 20*a* substantially parallel to the rear wall 12*a* of the marking engine, first and second side walls 20*b*, 20*c*, and top and bottom walls 20*d*, 20*e*, communicating so as to define a chamber. The chamber of the plenum housing 20 incorporates an inlet plenum 22 and an exhaust plenum 24 (see for example FIG. 2). The inlet plenum 22 has an inlet port 26 located in the lower portion of the side wall 20*b* of the housing 20 (see FIG. 3), and the exhaust plenum 24 has an exhaust port 28 located in the lower portion of the side wall 20*c* of the housing (see FIG. 4).

A unique advantage of the side locations for the inlet port 26 and the exhaust port 28 is that the reproduction apparatus 10 can be positioned right up against a wall of the user cite in which the reproduction apparatus is to be located. This minimizes the space need of the reproduction apparatus at the user cite, and maintains a minimum footprint for the reproduction apparatus.

The inlet plenum 22 and the exhaust plenum 24 respectively have internal baffle plates 30, 32. The baffle plates establish multiple turn ducts for the inlet plenum and exhaust plenum respectively (see FIGS. 3 and 4). All duct surfaces are lined with foam acoustic absorption material with a foil facing. The multiple turns in the respective inlet plenum and exhaust plenum ducts caused by the baffle plates 33, 32 produce reflections in the air flow through such ducts for maximum effective operation of the absorption material. Furthermore, the cross-sectional area of the ducts is selected to be as large as feasible to minimize inlet/exhaust impedance.

The inlet plenum 22 includes a filter, such as a catalytic Ozone filter 22*a* for example. Filtration of the input air by the filter 22*a* provides a unique advantage for the integrated environmental management system according to this invention in that it substantially reduces the detrimental effects of chemicals in the ambient air on the internal systems and elements of the reproduction apparatus 10. For example, air conditioning of the environment surrounding the reproduction apparatus 10 tends to promote the presence of amines in the ambient air. Such amines have been found to adversely effect the dielectric support member, thereby reducing its useful life. Further, the exhaust plenum 24 includes an Ozone filter 34. Ozone is produced by certain internal systems of the reproduction apparatus, such as corona chargers for example. The Ozone filter 34 is located as shown to provide maximum efficiency for reducing Ozone levels in the exhaust air flow admitted to the outside environment of the reproduction apparatus without exceeding the maximum allowable air flow rate.

Figure 5:
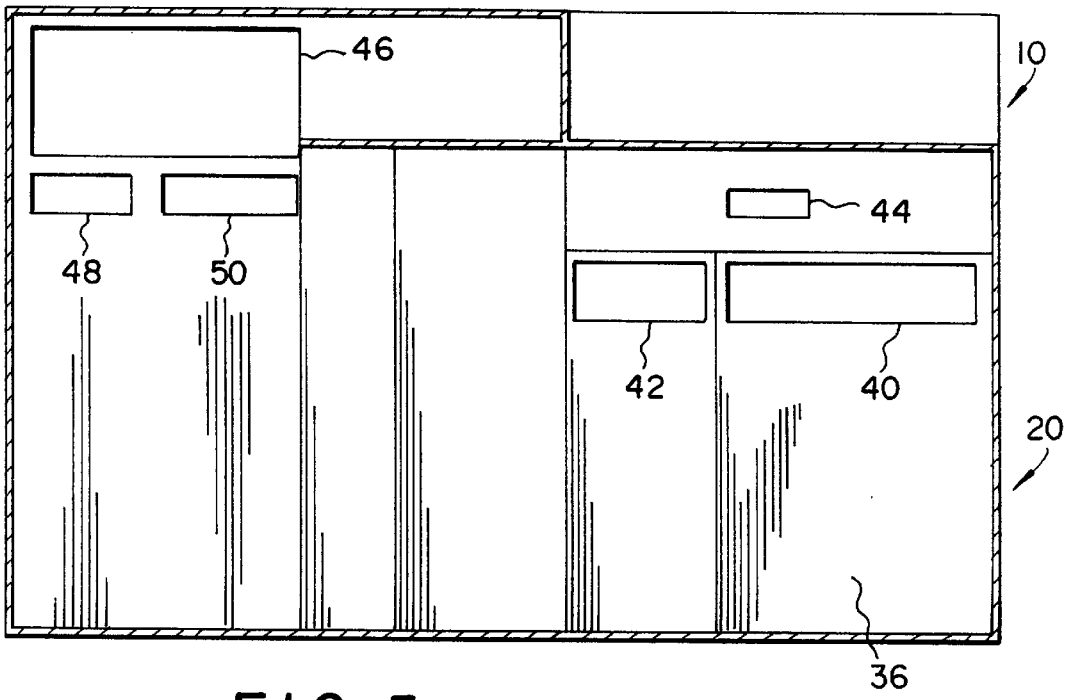
FIG. 5 is a rear elevational view of the reproduction apparatus of FIG. 1, partially in cross-section, and with portions removed to particularly show the integrated environmental management system.

As seen in FIG. 5, the rear side of the mech plate 36 for the reprographic marking engine 12 has a series of particularly located, and specifically sized ports 40–50. Referring to the inlet plenum side, port 40 provides the main inlet of cooling air flow from the inlet plenum 22 into the main section of the reprographic marking engine, and port 42 provides a ducted inlet to particular systems within the marking engine (such as, for example, the transfer station, the chargers, etc.). Port 44 provides a cooling air flow inlet to the scanner for the marking engine 12. As to the exhaust plenum side, the port 46 provides for the main exhaust of air flow from the main section of the reprographic marking engine 12 to the exhaust plenum 24 after it has performed the cooling function, and ports 48 and 50 provide ducted exhaust from particular systems within the marking engine. It should also be noted that the surface of the mech plate 36, facing the inlet and exhaust pleonasm, is covered with foam acoustic absorption material with a foil facing, similar for example to that foam acoustic absorption material with described above.

Figure 7:
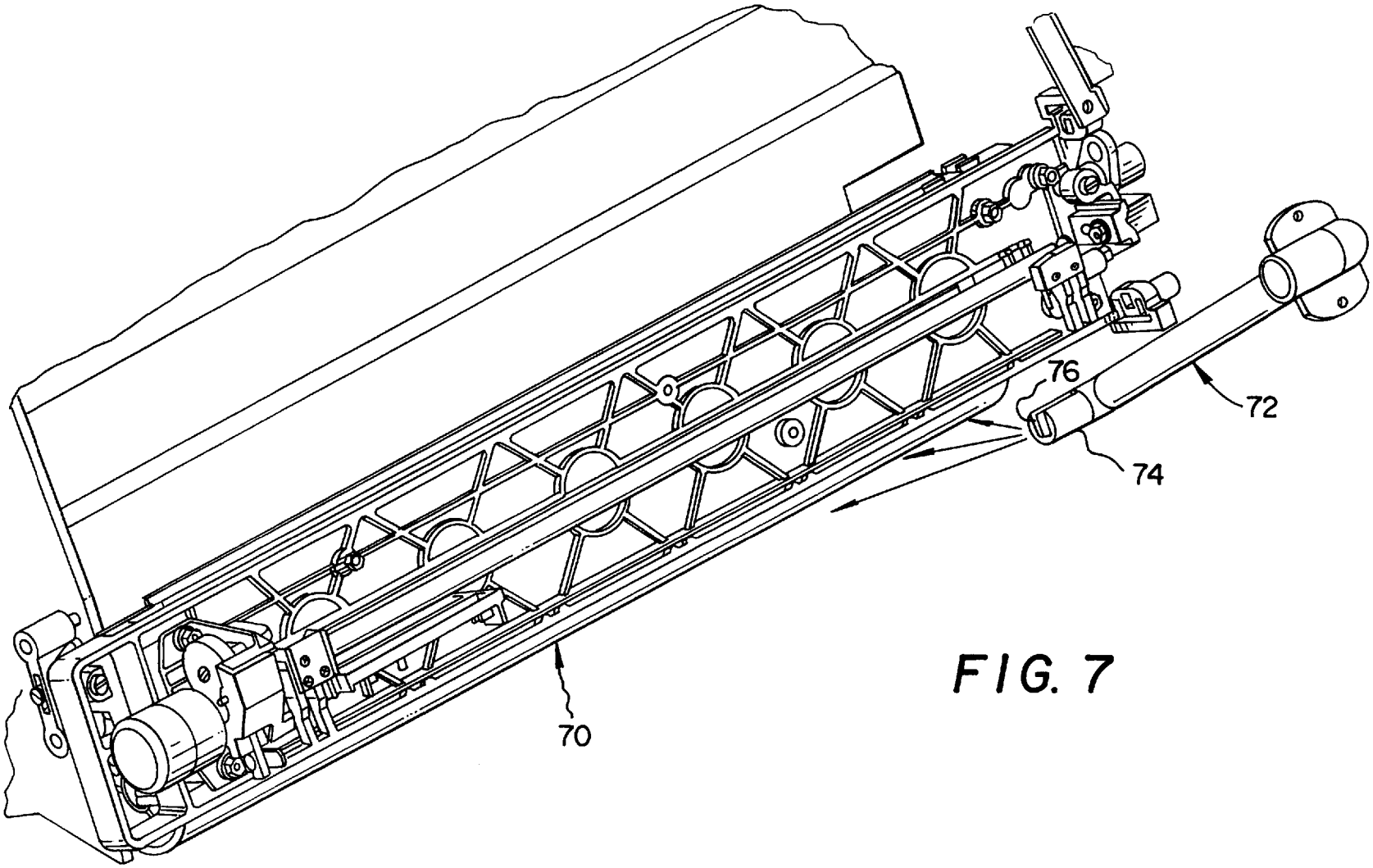
FIG. 7 is a view, in perspective, of the air flow directing device for the charger of the reproduction apparatus utilizing the integrated environmental management system according to this invention.

As noted, the ducted inlet established by port 42 provides a specific air flow to particular systems within the reprographic marking engine 12 of the reproduction apparatus 10. A particular representative example is best shown in FIG. 7. In FIG. 7, the ducted inlet air flow, from the inlet plenum 22 through the port 42, is directed to a corona charger 70 to remove stagnant air and generated Ozone from around the charger. This is necessary since otherwise corona contaminates can combine with water vapor in the ambient air to produce acids which can collect on the charger components and associated hardware. Particularly during periods of reproduction inactivity, the dielectric support member under the charger would be exposed to the formed acids with significant deleterious effects to the dielectric support member. Air flow is directed to the charger 70 by a conduit 72 having a flow directing nozzle 74. The nozzle 74 has a long, narrow slot 76 formed in the side of the nozzle facing the charger 70 adjacent to the rear of the charger. The slot is shaped to cross less than the complete end surface of the nozzle. As such, the air flow from the nozzle 74 is directed along the length, and across the width of the charger 70, from the rear of the charger toward the front. It has been found that the timing for the positive air flow is most effective when activated during the running of the reproduction apparatus. This is most likely due to the fact that the conditions most favorable to acid formation occur when the charger is operative during the reproduction cycle.

Figure 6:
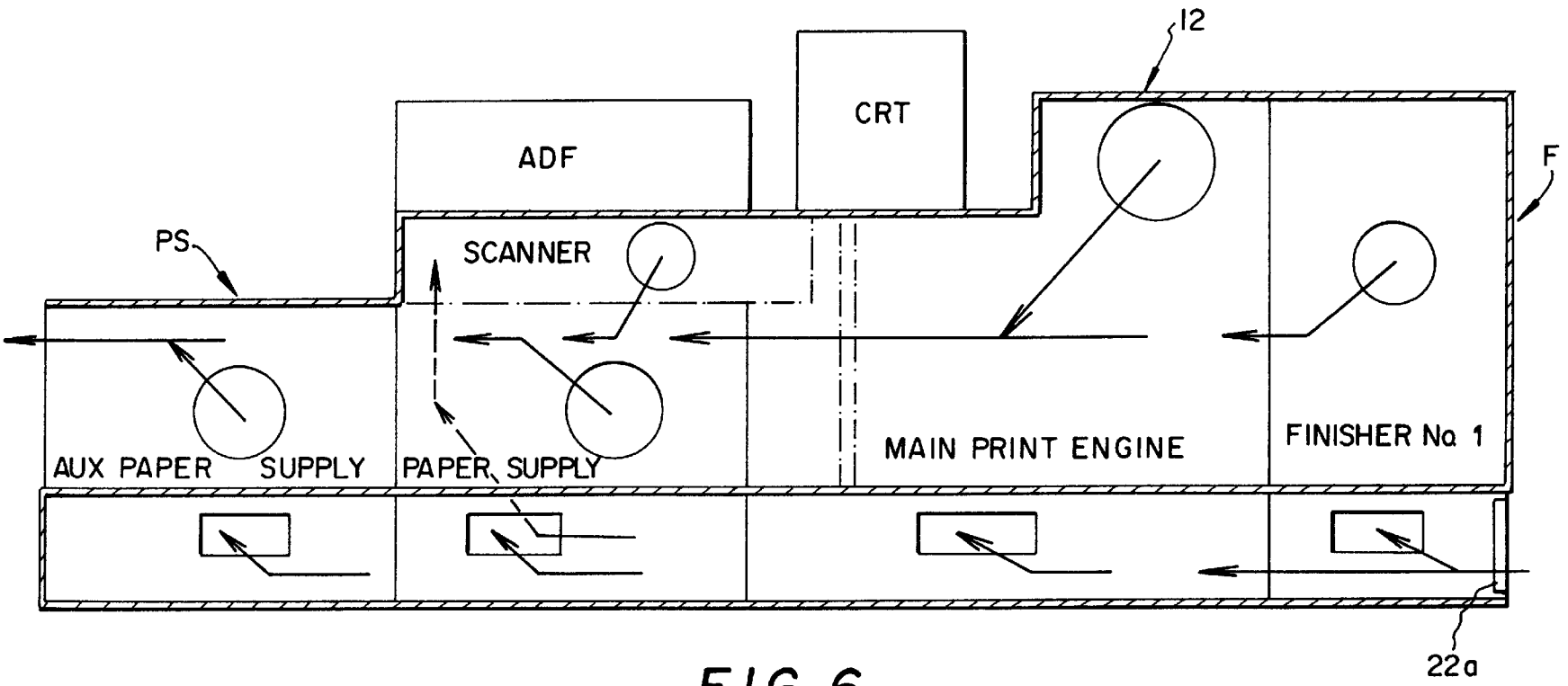
FIG. 6 is a front elevational view of the reproduction apparatus of FIG. 1, partially in cross-section, and with portions removed to particularly show the integrated environmental management system.

As discussed above, it is desirable that the integrated environmental management system according to this invention be readily adaptable to accommodate input and output accessories added to the reproduction apparatus 10. As best seen in FIG. 6, the reproduction apparatus includes the reprographic marking engine 12, one finisher unit F (located to the right of the marking engine when viewing the FIG. 6), and one auxiliary paper supply PS input accessory (located to the left of the marking engine when viewing the FIG. 6). To accommodate for the added accessories, the side walls for the housing 20 are merely moved out, and the top, bottom, and rear walls of the housing are extended.

Figure 9:
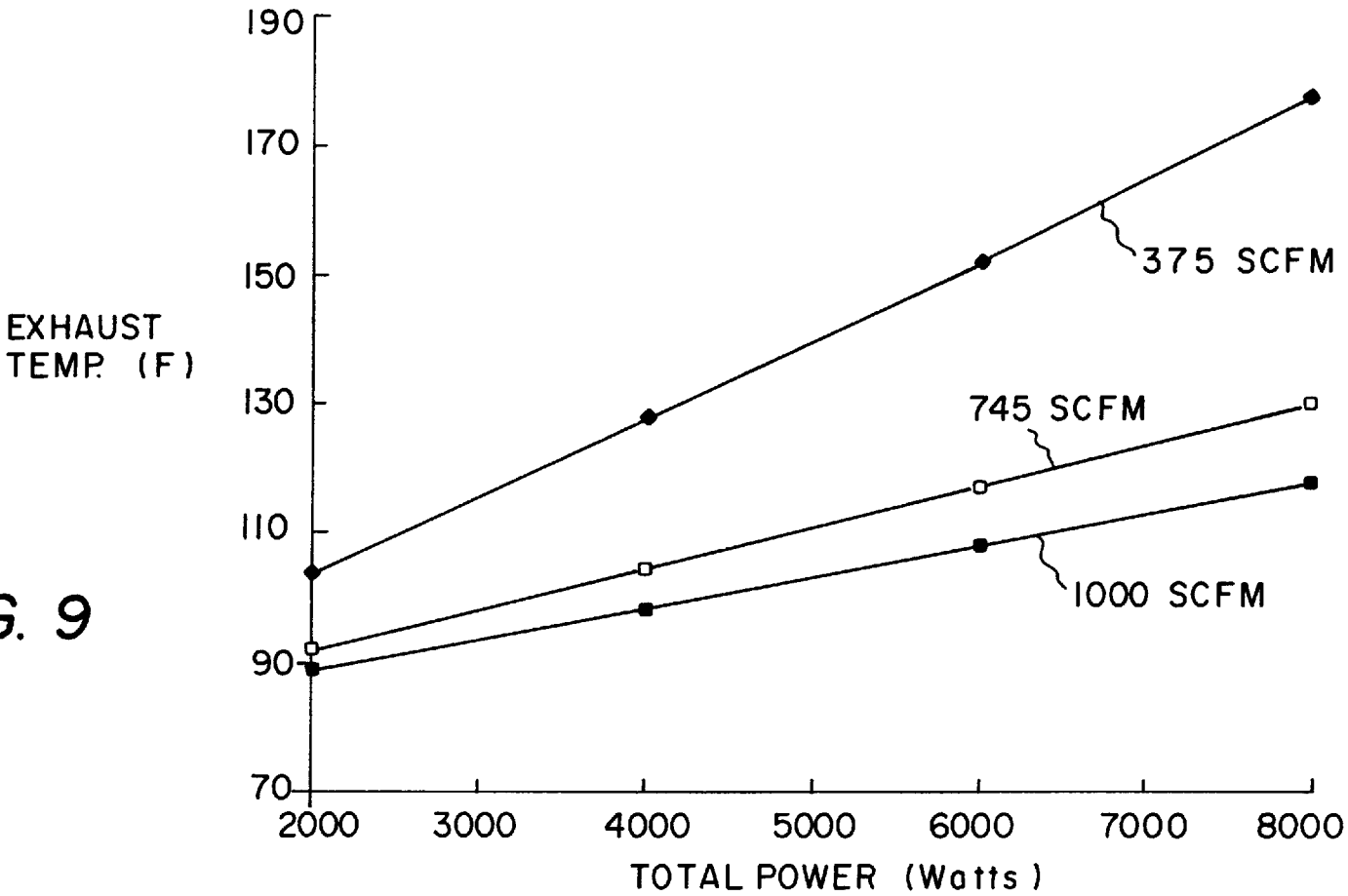
FIG. 9 is a graphical representation depicting air flow required to handle total power (in watts) for a desired exhaust temperature (in °F.).

The graph shown in FIG. 9 depicts air flow required to handle total power (in watts) for a desired exhaust temperature (in °F.). For a typical reproduction apparatus, such as for example the reproduction apparatus 10 shown in FIG. 1, the total power required is in the range of 7000 watts. Accordingly, from the graph of FIG. 9, to maintain an exhaust temperature of below 130° F., the required air flow must be in the range of 850 SCFM (standard cubic feet per minute). In order to provide such air flow, two fans 52, 54 are located in the wall of the plenum 20 in juxtaposition with the rear wall of the reproduction apparatus (see FIG. 4). The fans are, for example, 10" booster fans, such as the type fans generally referred to in the industry as reversed curve motorized impellers. As an additional feature, with fans of the described type, the air flow speed in the Ozone filter 34 is maintained below the maximum permissible air flow speed of approximately 200 FPM (feet per minute) for maximum filter efficiency.

Figure 8:
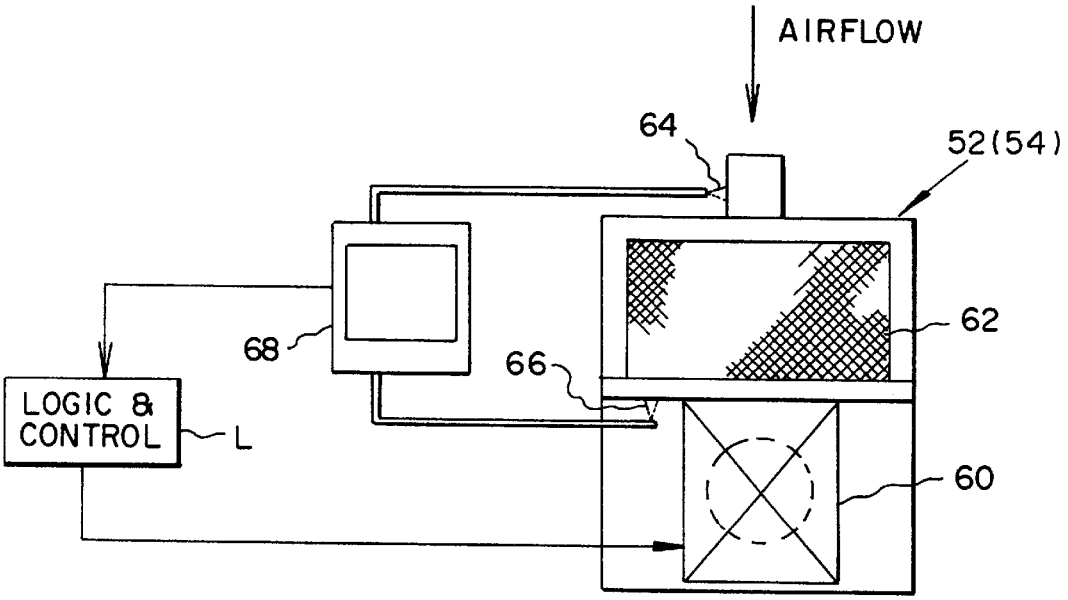
FIG. 8 is a schematic illustration of the speed control for the fans of the integrated environmental management system according to this invention.

As best shown in FIG. 8, the fans 52, 54 are of the type having a blower drawing air through, for example, a pleated filter 62 to trap particulate contaminates before such contaminates reach the blower or the environment surrounding the reproduction apparatus 10. As is well known, as the filter 62 fills up with collected contaminates, the pressure drop across the filter increases. In order to maintain air flow within a desired range to assure efficient cleaning of the environment for the reproduction apparatus 10, according to this invention the blower 60 is selected to be a DC blower with an analog speed control. Pressure ports 64, 66 are located in operative association with the input and output sides of the filter 62 respectively. A pressure transducer 68 is coupled to the pressure ports 64, 66 to measure the pressure drop across the filter. The pressure transducer 68 generates a signal corresponding to the pressure drop across the filter. A change in the pressure drop could be caused by the collection of debris in the filter or the filter becoming disconnected from the flow system for example. The pressure transducer signal is transmitted to the logic and control unit L of the reproduction apparatus 10 for example. The unit L can adjust the speed of the blower 60 based on the pressure drop signal from the pressure transducer 68 to compensate for any change in impedance in the filter and maintain an optimum air flow therethrough. In addition, the level of speed increase (decrease) of the blower can be quantified such that at a certain threshold speed an appropriate warning may be provided that the filter is no longer operating efficiently and needs to be cleaned or replaced.

It should also be noted that the described pressure transducer controlled blower, shown in FIG. 8, is also suitable for use with the blower for the cleaning system of the typical reprographic marking engine. An exemplary reprographic marking engine cleaning system includes a cleaning brush for removing residual marking particles and other debris from the dielectric support member prior to reuse. The marking particles and other debris are entrained in an air flow generated by a filtered blower and passed through a cyclone separator to remove the larger particles, with the exhaust air then being directed (e.g., through the integrated environmental management system according to this invention) into the environment. In this instance, in order to maintain air flow in the cleaning station within a desired range, the blower may similarly be selected to be a DC blower with an analog speed control. Pressure ports in operative association with the input and output sides of the filter for the cleaning station have a pressure transducer coupled thereto to measure the pressure drop across the filter. As described above, a signal generated by the pressure transducer, corresponding to the pressure drop across the filter, is transmitted to the logic and control unit L of the reproduction apparatus 10. The unit L can then adjust the speed of the cleaning station blower based on the pressure drop signal from the pressure transducer to compensate for any change in impedance in the filter and maintain an optimum air flow therethrough. As above, the level of speed increase (decrease) of the blower can be quantified such that at a certain threshold speed an appropriate warning may be provided that the filter is no longer operating efficiently and needs to be cleaned or replaced.

The invention has been described in detail with particular reference to the preferred embodiment thereof, but it will be understood that variations and modifications can be effected within the spirit and scope of the invention as set forth in the claims.

What is claimed is:

1. An integrated environmental management system for reproduction apparatus including a reprographic marking engine for reproducing information supplied thereto and accessories for facilitating the handling of reproduction output from the marking engine, said integrated environmental management system comprising:

a housing associated with said reprographic marking engine, in juxtaposition with said reprographic marking engine, said housing defining a chamber;

an inlet plenum in said housing chamber, said inlet plenum including an inlet filter for preventing contaminants in ambient air from entering said inlet plenum, a first inlet duct directed into the general interior of said reprographic marking engine, and a plurality of inlet ducts directed respectively to specific system within said reprographic marking engine;

an exhaust plenum in said housing chamber, said exhaust plenum including a first exhaust duct directed from the general interior of said reprographic marking engine, a plurality of exhaust ducts directed respectively from specific systems within said reprographic marking engine, and a filter for preventing contaminants carried by air flow from within said reprographic marking engine from exiting said exhaust plenum; and at least one fan for moving air from said inlet plenum through said reprographic marking engine and through said exhaust plenum, said at least one fan having a control for regulating the speed thereof to maintain a desired air flow for a given power output of said reprographic marking engine.

2. The integrated environmental management system according to claim 1, wherein said housing and all of said inlet and exhaust ducts of said inlet plenum and said exhaust plenum respectively are lined with an acoustic foam absorbing material.

3. The integrated environmental management system according to claim 2, wherein said inlet and exhaust ducts are configured to be long and have multiple turns so as to maximize the amount of acoustic foam absorbing material utilized therein and provide maximum effect for said acoustic foam absorbing material.

4. The integrated environmental management system according to claim 3, wherein said inlet and exhaust ducts have a large cross-sectional area to minimize impedance caused by said ducts.

5. The integrated environmental management system according to claim 1, wherein said at least one fan includes a filter, a DC analog speed control blower, and a pressure transducer for measuring the pressure drop across said filter and generating a signal corresponding to the measured pressure drop.

6. The integrated environmental management system according to claim 5, wherein said control for at least one fan includes means responsive to said signal from said pressure transducer for regulating the speed of said blower to maintain the desired air flow.

7. The integrated environmental management system according to claim 1, wherein one of said plurality of inlet ducts directs air flow at a corona charger of said reprographic marking engine.

8. The integrated environmental management system according to claim 7, wherein said one of said plurality of inlet ducts directing air flow at a corona charger of said reprographic marking engine includes a nozzle having a slot defined therein for directing a flow of air at said charger along the length, and across the width of said charger from the rear of said charger toward the front.

9. The integrated environmental management system according to claim 1, wherein one of said plurality of exhaust ducts communicates with a cleaning system of said reprographic marking engine and directs air flow therefrom, said cleaning system including a fan having a filter, a DC analog speed control blower, a pressure transducer for measuring the pressure drop across said filter and generating a signal corresponding to the measured pressure drop, and means responsive to said signal from said pressure transducer for regulating the speed of said blower to maintain a desired air flow.

10. An integrated environmental management system for reproduction apparatus including a reprographic marking engine for reproducing information supplied thereto and accessories for facilitating the handling of reproduction output from the marking engine, said integrated environmental management system comprising:

a housing associated with said reprographic marking engine, in juxtaposition with substantially the full width and height of said reprographic marking engine, said housing having a rear wall substantially parallel to the rear of said reprographic marking engine, first and second side walls, and top and bottom walls communicating so as to define a chamber;

an inlet plenum in said housing chamber communicating with an opening in said first side wall of said housing, said inlet plenum including an inlet filter for preventing contaminants in ambient air from entering said inlet plenum through said opening in said first side wall, a first inlet duct directed into the general interior of said reprographic marking engine, and a plurality of inlet ducts directed respectively to specific systems within said reprographic marking engine;

an exhaust plenum in said housing chamber communicating with an opening in said second side wall of said housing, said exhaust plenum including a first exhaust duct directed from the general interior of said reprographic marking engine, a plurality of exhaust ducts directed respectively from specific systems within said reprographic marking engine, and a filter for preventing contaminants carried by air flow from within said reprographic marking engine from exiting through said opening in said second side wall; and at least one fan for moving air from said inlet plenum through said reprographic marking engine and through said exhaust plenum, said at least one fan having a control for regulating the speed thereof to maintain a desired air flow for a given power output of said reprographic marking engine.

11. The integrated environmental management system according to claim 10, wherein the interior of all of said walls of said housing and all of said inlet and exhaust ducts of said inlet plenum and said exhaust plenum respectively are lined with an acoustic foam absorbing material.

12. The integrated environmental management system according to claim 11, wherein said inlet and exhaust ducts are long so as to maximize the amount of acoustic foam absorbing material utilized therein.

13. The integrated environmental management system according to claim 11, wherein said inlet and exhaust ducts have multiple turns to provide maximum effect for said acoustic foam absorbing material.

14. The integrated environmental management system according to claim 11, wherein said inlet and exhaust ducts are configured to be long and have multiple turns so as to maximize the amount of acoustic foam absorbing material utilized therein and provide maximum effect for said acoustic foam absorbing material, and have a large cross-sectional area to minimize their impedance.

15. The integrated environmental management system according to claim 10, wherein said at least one fan includes a filter, a DC analog speed control blower, and a pressure transducer for measuring the pressure drop across said filter and generating a signal corresponding to the measured pressure drop, and wherein said fan control includes means responsive to said signal from said pressure transducer for regulating the speed of said blower to maintain the desired air flow.

16. The integrated environmental management system according to claim 10, wherein one of said plurality of inlet ducts directs air flow at a corona charger of said reprographic marking engine.

17. The integrated environmental management system according to claim 16, wherein said one of said plurality of inlet ducts directing air flow at a corona charger of said reprographic marking engine includes a nozzle having a slot defined therein for directing a flow of air at said charger along the length, and across the width of said charger from the rear of said charger toward the front.

18. The integrated environmental management system according to claim 10, wherein one of said plurality of exhaust ducts communicates with a cleaning system of said reprographic marking engine and directs air flow therefrom, said cleaning system including a fan having a filter, a DC analog speed control blower, a pressure transducer for measuring the pressure drop across said filter and generating a signal corresponding to the measured pressure drop, and means responsive to said signal from said pressure transducer for regulating the speed of said blower to maintain a desired air flow.

19. A cleaning system in association with a reprographic marking engine for directing air flow therefrom, said cleaning system comprising:

a fan having a filter, a DC analog speed control blower, a pressure transducer for measuring the pressure drop across said filter and generating a signal corresponding to the measured pressure drop, and means responsive to said signal from said pressure transducer for regulating the speed of said blower to maintain a desired air flow.

* * * * *